United States Patent [19]

Gerry

[11] 4,451,764

[45] May 29, 1984

[54] IGNITION SYSTEM HIGH VOLTAGE CABLE WITH MINIMIZED RADIO INTERFERENCE

[76] Inventor: Martin E. Gerry, 13452 Winthrope St., Santa Ana, Calif. 92705

[21] Appl. No.: 491,750

[22] Filed: May 5, 1983

[51] Int. Cl.[3] ..... H05B 37/02; H05B 39/04; H05B 41/36

[52] U.S. Cl. ..... 315/209 R; 315/85; 123/633; 333/140

[58] Field of Search ..... 315/85, 209, 209 R, 315/209 T; 123/633; 333/140, 167

[56] References Cited

U.S. PATENT DOCUMENTS

| | | | |
|---|---|---|---|
| 1,972,319 | 9/1934 | Rypinski | 333/140 X |
| 2,081,979 | 6/1937 | Bentley | 123/633 |
| 2,189,913 | 2/1940 | McCarty | 315/85 |
| 2,243,881 | 6/1941 | Peters et al. | 315/85 |
| 3,191,132 | 6/1965 | Mayer | 315/85 X |
| 3,384,061 | 5/1968 | Hanysz | 123/633 |
| 3,421,119 | 1/1969 | Zerkin | 333/140 |
| 4,191,155 | 3/1980 | Nishio et al. | 123/633 |
| 4,422,054 | 12/1983 | Gerry | 315/85 |

*Primary Examiner*—Saxfield Chatmon

[57] ABSTRACT

An ignition system utilizes a bipolar activated magnetic pulse timer which effectively makes operation of the timer independent of the automotive supply voltages. Such system utilizes a distributed parameter component which may be utilized as a shunt across the ignition transformer secondary winding and also as a high voltage ignition distribution cable. The use of the distributed parameter component as a shunt enables extremely high energy levels to be generated. The use of the distributed parameter component as a distribution cable enables high energy levels to be transferred to the igniters without radio noise induction in a contiguous radio receiver.

4 Claims, 19 Drawing Figures

IGNITION SYSTEM HIGH VOLTAGE CABLE WITH MINIMIZED RADIO INTERFERENCE

TECHNICAL FIELD

This invention is in the field of magnetic pulse timers of engine ignition systems including high energy ignition transformers and high ignition energy distribution cables.

BACKGROUND ART

The prior art ignition systems utilizes a magnetic pulse timer coupled to a semiconductor switch. Such switch is unipolar responsive and dependent upon the DC power source used to energize the ignition system. When the power source drops in voltage level or rises in voltage level outside the operating limits of the switch, the timer fails to trigger and activate the ignition system.

The prior art ignition systems also utilize high voltage ignition cables either of hard wire conductors or high resistance elements as conductors embedded in an insulation.

The hard wire embedded conductor cable provides substantially no attenuation of ignition current that it supplies to the engine's electrical igniter, but produces large electromagnetic fields that cause noise to be induced in the antenna of an automotive receiver.

The carbon or other high resistance embedded conductor cable is generally of the order of 15,000 ohms DC resistance. Whereas such high resistance reduces the electromagnetic radiation, it nevertheless causes substantial reduction of ignition current in the secondary high voltage ignition transformer circuit and hence causes a substantial decrease in electrical energy delivered to the igniter.

Noise reduction due to ignition system operation is presently limited to cables having very high ohmic resistance which attenuates generated ignition current by factors greater than 10,000. Such high attenuation affects the ability of an ignition system to provide sufficient ignition current resulting in substantially reduced engine performance and engine operating efficiency, taking its toll in increased fuel consumption that would otherwise not be required.

Presently, the prior art does not possess ignition transformers capable of delivering high energy quantities to the engine's igniters.

SUMMARY OF THE INVENTION

It is an objective of this invention to provide a magnetic pulse input circuit that is independent of the DC power voltage levels provided by any DC power source.

It is another objective of this invention to create a high voltage distributed capacity cable which by its own structure cancels its own generated electric and magnetic field components so as to minimize electromagnetic radiation therefrom.

It is yet another objective of this invention to utilize a distributed capacity shunt across the ignition transformer secondary winding so as to greatly increase the energy level delivered to the igniters.

The instant invention utilizes a pair of semiconductor switches of opposite conductivities coupled to the timer winding. The input circuit to the pair of semiconductor switches of opposite conductivities is independent of any DC voltage or power input and hence will function no matter what level the DC power source voltage rises to or drops to. The output for such pair of switches produces more than double the conventional voltage output to trigger the power semiconductor or semiconductors of the ignition system.

A high voltage cable is constructed utilizing a pair of twisted or transposed turns of electrically insulated wires wherein one end of each of the wires remains unterminated, and the other ends of each wire may be terminated in a connector. Thus, the result is distributed capacity coupling between these wires over the entire length of the cable. In its use in ignition circuits, such as a distributed capacity shunt across the ignition transformer secondary, and/or as connecting means between the ignition transformer secondary and distributor and between ditributor and each of the igniters, such cable permits an increased ignition current flow. The transposition of the pair of wires results in cancellation of magnetic field components along the cable length and ceancellation of electric field components between each wire pair.

Three additional structures of the cable are disclosed wherein only two of such structures are usable as shunts and only two are practical for use as high voltage distribution means.

DETAILED DESCRIPTION

Figure 1:
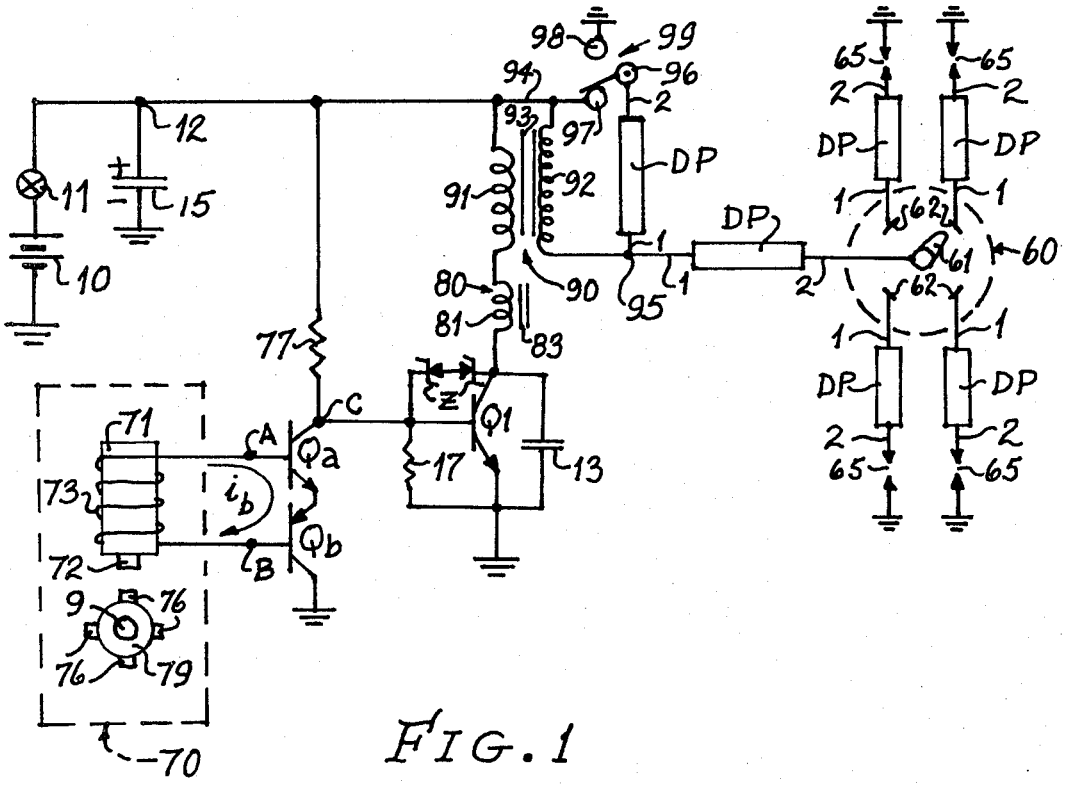
FIG. 1 is an electrical schematic of an ignition system having triggering means that is independent of any DC power source.

Referring to FIGS. 1 through 5, the best mode of the invention of an ignition system including its distributed parameter element DP, is illustrated at several locations of the system connected by means of terminations 1 and 2 thereof to such several locations. Included in such illustration is a commonly used magnetic pulse timer 70 and high voltage distributor 60 as well as igniters 65 commonly found in most automobiles.

The illustrated ignition system is used to trigger a bipolar activated logic circuit comprised of transistors $Q_a$ and $Q_b$ of opposite semiconductor conductivities. Transistor $Q_a$ is of the NPN type and transistor $Q_b$ is of PNP type, emitter-to-emitter connected with leads A and B of magnetic pulse timer winding 73 connected to the bases of $Q_a$ and $Q_b$ respectively.

Timer 70 is otherwise conventional, having a permanent magnet core 71 upon which winding 73 is wound, and having a magnetic pole piece 72 used to magnetically sense pulses induced in winding 73 when reluctor rotor 79 having protrusions 76 thereon is driven by automotive distributor shaft 9, so that each time one of protrusions 76 passes pole piece 72, a voltage waveform as illustrated at F or G is induced in winding 73 at leads A and B.

Such waveform may be visually observed with an oscilloscope when leads A and B are not connected to the bases of transistors $Q_a$ and $Q_b$ and when such leads are connected to the oscilloscope's vertical input terminals.

Whether waveform F or G will be observed, will depend upon which of leads are connected to which of the vertical input terminals of the oscilloscope. One of the oscilloscope terminals is usally at ground potential whereas the other terminal is above ground potential. Consequently, assuming that the magnetic polarity established in core 71 and direction of turns of wire of winding 73 are such so as to render waveform F when A is connected to the oscilloscope terminal above ground potential, and B is connected to the oscilloscope terminal at ground potential, then transposing leads A and B with respect to the oscilloscope terminals will result in a display of waveform G. Since waveform F exhibits a conventional positive-going slope, from lower left to upper right direction, waveform F will be designated as possessing a positive slope, and conversely waveform G will be designated as possessing a negative slope.

Positive slope waveform F is generally preferred due to sharper switching cut-off characteristics exhibited thereby, although the negative slope waveform G may effectively be utilized by transposition of leads A and B to the base inputs of $Q_a$ and $Q_b$.

It is obvious that when rotor 79 is at standstill, no voltage will be induced in winding 73 and no waveform F or G will be present across leads A and B.

When DC voltage from battery 10 fed through ignition switch 11 is applied to the collector of $Q_a$ at C through resistor 77, and rotor 79 is driven by shaft 9, waveform voltage F having excursions of $\pm 10$ volts induced in winding 73 is applied between A and B to the bases of $Q_a$ and $Q_b$ to create base current $i_b$ in both bases, thereby enabling collector current to flow in $Q_a$ and $Q_b$ between positive terminal 12 and ground, turning ON $Q_a$ and $Q_b$ to their conductive states and lowering the potential at C from a positive value to ground potential.

Assuming, that the magnetic switch is such as above described so as to provide waveform F between leads A and B, base current $i_b$ will flow in both bases of $Q_a$ and $Q_b$ when the positive pulse component of waveform F is applied at A, in which situation B will be at a negative potential at the same instant of time, thereby establishing the base of $Q_a$ at a positive potential and the base of $Q_b$ at a negative potential, which are the required potentials to create base currents in both $Q_a$ and $Q_b$. Thus, collector current will flow in $Q_a$ and $Q_b$ to cause these transistors to simultaneously switch from their OFF or nonconductive to their ON or conductive states.

The collector at C is connected to the base of NPN power transsitor Q1 which is switched between its ON and OFF states in accordance with the potential at C.

Transistor Q1 is protected against high voltages appearing between its collector and emitter during its OFF state by means of resistor 17 and zener diodes Z, and also by inductor 80 which serves to lower the collector-emitter voltage of Q1 during its OFF state. Zener diodes are back-to-back connected to provide bipolarity protection since the voltage across Q1 in its OFF state is bipolar. Accordingly, collector to base voltage of Q1 will be limited to the zener diode knee voltage, and base to ground voltage will be substantially limited to the zener knee voltage due to the low resistance value of resistor 17 connected between the base and emitter of Q1. With such connection, the combination of zener Z and resistor 17 effectively limits collector-emitter and collector-base voltages to the zener knee values and thereby protects Q1 in its OFF state.

The collector of Q1 is connected to winding 81 of charge accumulator inductor 80. Winding 81 is wound on a magnetizable core 83, generally of the torroidal type. The other end of winding 81 is connected to one end of primary winding 91 of a standard ignition transformer 90 of an 80:1 turns ratio as used in automotive ignition systems, the other end of winding 91 at 94 being generally a common connection terminal with one end of secondary winding 92. End 95 of winding 92 is the high voltage distribution point to which is coupled distributed parameter elements DP, as hereinbelow discussed.

Capacitor 13, shunting collector-emitter terminals of Q1, may be optionally included. Capacitor 15 is a high capacitive low voltage electrolytic capacitor connected across the DC input terminals of the ignition circuit so as to provide a low AC current return path to compensate for inductance in the cables connecting the ignition circuit to DC power means of an automotive power source.

Briefly, when rotor 79 is at standstill, or when A is at a negative potential, C will be at a positive potential and Q1 will be conductive to permit DC current to flow through windings 81 and 91 so as to charge those windings and cores 83 of inductor 80 and 93 of of transformer 90, and capacitor 13, if used, will be short-circuited. When waveform F provides a positive potential at A thus also placing B at a negative potential, due to rotation of reluctance wheel 79, to cause protrusions 56 to pass pole piece 52, base current $i_b$ in $Q_a$ and $Q_b$ will flow to cause $Q_a$ and $Q_b$ to conduct, thereby lowering point C through zero potential to a high negative potential to turn transistor Q1 to its OFF state, thereby discharging inductor 80 into winding 91 while also discharging winding 91 to induce a high voltage in winding 91. If capacitor 13 is utilized, then the discharge currents from inductor 80 and winding 91 will pass therethrough in oscillatory fashion.

The benefit of bipolar timing switch $Q_a$ and $Q_b$ may be appreciated by examining the base to emitter voltage waveforms $V_{BE}$ of $Q_a$ and $Q_b$ illustrated as waveforms H and J, each having an amplitude of 7 volts. During conduction of $Q_a$ the base to emitter voltage $V_{BE}$ will drop from +7 volts to zero volts, whereas the base to emitter voltage $V_{BE}$ of $Q_b$ will rise from −7 volts to zero volts, thereby resulting in a base to base voltage between A and B of 14 volts, and $Q_a$ and $Q_b$ will simultaneously switch from their OFF to their ON states to turn Q1 from its ON to its OFF state.

Transistor Q1 will initially be conductive or in its ON state as shown by waveform K. The base to emitter voltage $V_{BE}$ of Q1 during its ON state will be at +2 volt potential, dropping sharply past zero potential level to about −11 volt potential for a short period of time, by virtue of point C undergoing these potential changes, to turn Q1 from its ON to its OFF state, and then turning Q1 back to its conductive or ON state when $Q_a$ and $Q_b$ are turned OFF by virtue of operation of timer 70.

The switching logic of the foregoing system may be briefly summarized in tabular form as follows:

| Protrusion 76 | Potential at A | Potential at B | $Q_a$ | $Q_b$ | Potential at C | Q1 | 81 & 91 |
|---|---|---|---|---|---|---|---|
| is not driven past armature 72 | 0 | 0 | OFF | OFF | +2 | ON | charge |
| is driven past armature 72 | + | − | ON | ON | −11 | OFF | discharge |

An advantage is gained utilizing the trigger circuit of $Q_a$ and $Q_b$, in that such trigger activation by virtue of generation of waveform F or G as an input to $Q_a$ and $Q_b$, makes triggering and switching initiation independent of the DC power source of the ignition system and consequently independent of its voltage and current variations.

It should also be noted that although a pair of NPN-PNP transistors were utilized for $Q_a$-$Q_b$, there appears to be no reason why a suitable pair of unijunction transistors of different conductivities or a pair of field effect transistors of different conductivities or similar structures in an integrated circuit could not be used as substitutes.

The ignition system utilizes a conventional high voltage distributor 60 having a rotor element 61 and stator elements 62. Igniters 65 are coupled to the stator elements via distributed parameter DP at terminations 1 and 2 thereof, one distributed parameter DP acting as an ignition distribution cable per one igniter 65. Distributed parameter cable DP is also used as means for coupling, between its terminals 1 and 2, rotor 61 to high voltage terminal 95 of ignition transformer secondary winding 92.

Distributed parameter DP is also usable as a shunt to provide an alternating current path in parallel with the current path of the secondary winding, by coupling distributed parameter DP via its terminals 1 and 2 in each of two alternate ways to winding 92. Distributed parameter DP is connected via its terminal 1 to high voltage point 95, and terminal 2 is connected to center member 96 of a two-position switch 99, while common terminal 94 of transformer 90 is connected to member 97 of such switch. A first manner of coupling distributed parameter DP is by virtue of switch members 96 and 97 being in cooperation. In a second manner of coupling distributed parameter DP, switch member 96 cooperates with switch member 98 of switch 99. Member 98 being at ground potential, distributed parameter DP is connected between terminal 95 and ground, which for the purpose of producing a shunt path to alternating current flow in parallel with the current flow path of the secondary winding, is identical to the first manner of coupling since effectively both methods of coupling the distributed parameter DP are identical for alternating current flow.

Commercially available components utilized in the illustrated ignition system are:

| Component | Value or Type |
|---|---|
| $Q_a$ | 2N3773 or 2N3055H |
| $Q_b$ | 2N6609 |
| Q1 | MJ 15024 Motorola or 2N6547 |
| Z | 1N5388 |
| 13 | 0.25 microfarad, 400 volts |
| 15 | 250 microfarad electrolytic, 50 volts |
| 17 | 50 ohms, 0.5 watts |
| 77 | 100 ohms, 2 watts |
| 90 | 80:1 turns ratio ignition transformer |

It should be noted that the conventional ground symbol is utilized for both DC and AC return paths of FIG. 1 illustration.

Figure 2:
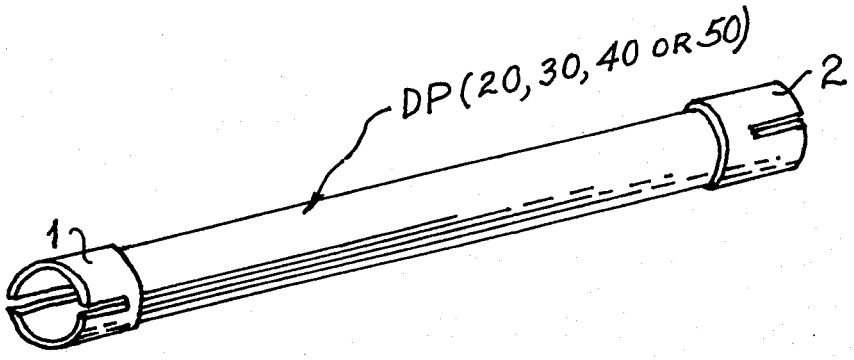
FIG. 2 is a perspective view of a distributed parameter component used in the circuit of FIG. 1, and representing four different variations of such distributed parameter component.
Figure 3:
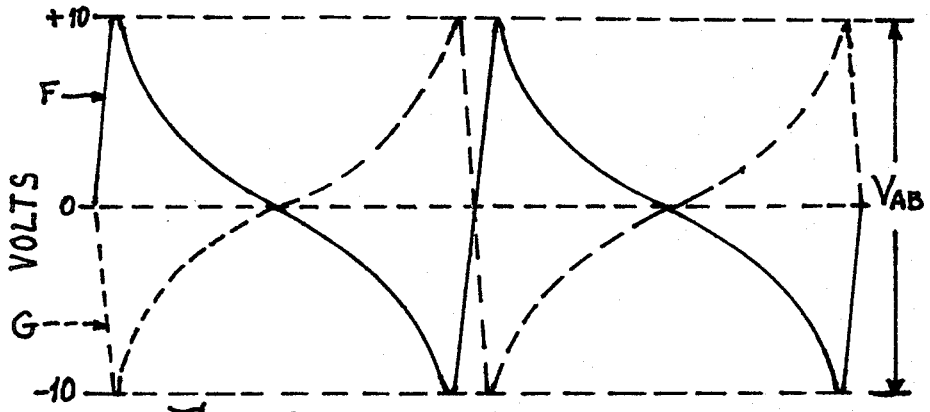
FIGS. 3, 4 and 5 are copies of oscilloscopic traces of the performance characteristic of the triggering means of FIG. 1.
Figure 4:
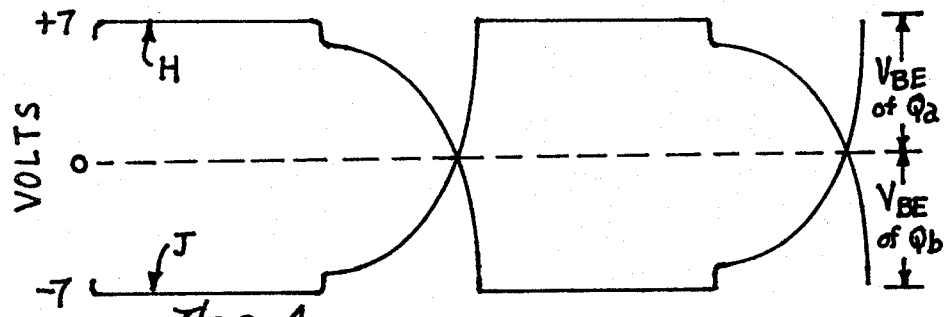
Figure 5:
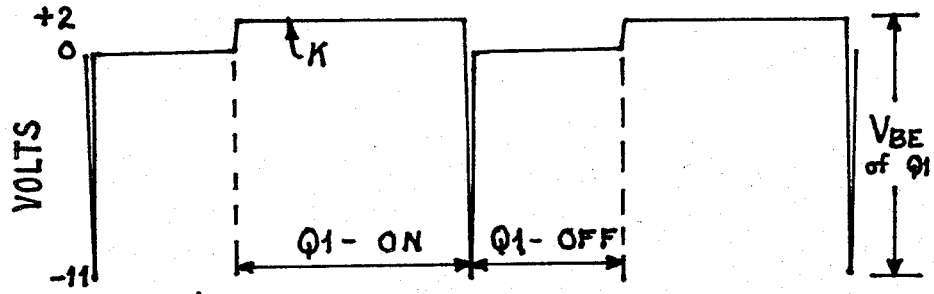
Figure 6:
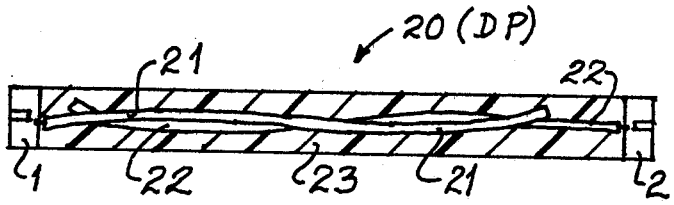
FIG. 6 is a cross-section view partially in elevation of a first version of the distributed parameter component illustrated in FIG. 2.
Figure 7:
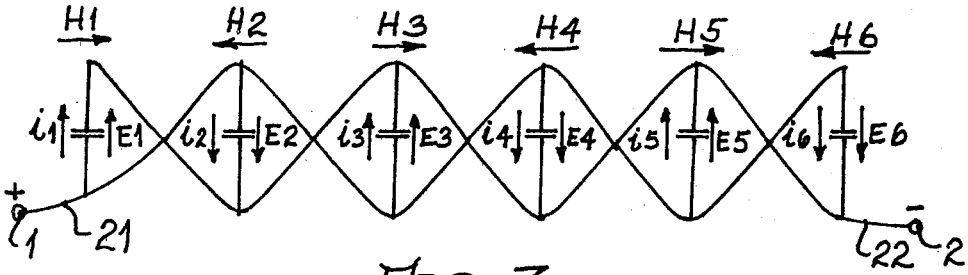
FIG. 7 is a graphical representation of the ignition current flow, electric field and magnetic field relationships involving the structure of FIG. 6.

Referring to FIGS. 6 and 7, one form of distributed parameter component DP as shown in FIGS. 1 and 2, is illustrated at 20. Such component 20 has utilization as both a shunt for secondary winding 92 and a high voltage distribution cable coupling the secondary winding to igniter 65.

Component 20 takes advantage of the principle of distributed capacity between a pair of twisted or transposed wires, in segmentary portions, effecting ignition alternating current conduction through the distributive capacities inherent in component 20, such component having its terminations 1 and 2 for connection in the structure of FIG. 1.

Component 20 comprises a pair of twisted pair of insulated wires 21 and 22 in segmentary transposition structure. The insulation one these wires may be a dielectric material such as polytetrafluroethylene (trade name TEFLON) surrounding an electrical conductor each. Wires 21 and 22 are embedded in a good electrical insulating jacket 23 of suitable thickness and of high heat resistive composition. Wire 21 has one end thereof connected at termination 1 and the other end thereof is unterminated. Wire 22 has one end thereof connected at termination 2 and the other end of such wire is unterminated. Terminations 1 and 2 are at opposite ends of the wire pair 21-22. Hence the electrical terminations at 1 and 2 are used to make the connections as shown in FIG. 1.

The opposite ends of each wire that are unterminated, enables the wire pair 21-22 to exhibit a continuous distributed capacity that is realized over the length of component 20. The pitch of the transposed wires over each other is not critical but should be as tight or as close together as possible. Each of wires 21 and 22 may have center conductors of about number 18 or 20 gauge.

Since component 20 electrically shunts winding 92, a high secondary current will be established circulating in the parallel circuit comprising component 20 and winding 92, in conjunction with a high secondary voltage delivered to igniters 65 during ignition periods of the system.

It should be noted that connection of component 20 in shunt configuration between terminal 95 and ground will obtain the same results as obtained when component 20 is connected across secondary winding 92.

The electrical equivalent circuit of component 20 is given by FIG. 7, showing wires 21 and 22 and their respective terminations 1 and 2 having a number of transposed turns of these wires. Each of the turns of wire pair is illustratively expanded so that the electromagnetic field components can be ascertained and illustrated.

Assuming at one instant of time that termination 1 of wire 21 is at a positive potential and termination 2 of wire 22 is at a negative potential with respect to the potential at 1 due to ignition current flow comprising displacement current components i1, i2, i3, i4, i5 and i6, created by their respective electric field components E1, E2, E3, E4, E5 and E6, it can be seen that component 20 as structured acts as a distributed capacitor with a theoretically infinite number of capacitive elements traversing the length of wires 21-22. As an example, since electric field vector E1 will be established in a direction from the positively charged wire 21 to the negatively charged wire 22, electric field vector E2 will also be established in a direction from its positively charged wire to its negatively charged wire, but due to wire segment transposition, electric field vector E2 will be in a direction opposite to electric field vector E1. Hence, currents i1 and i2 will be displaced in opposing directions, but each current will be displaced in the same direction as its electric field vector component. Consequently, although the electric field vectors will change in direction with every turn of wire, and thereby effect field vector cancellation, the displacement currents will pass between wires 21 and 22 in similar manner as displacement current transfers between plates of a capacitor in a manner documented by Maxwell's equations. It is well known that ignition current is a complex transient which a capacitor will readily pass.

Applying the right hand rule of current and magnetic field directions, it can be seen from the diagram that magnetic field vector component H1 will be perpendicular to current component i1, and that magnetic field vector component H2 will be perpendicular to current component direction i2. Since displacement current i1 is in opposite direction to displacement current i2 the direction of vecotr H1 will be opposite to the direction of vector H2 and of equal magnitude, thus cancelling each other insofar as inducing a magnetic field into the antenna of the radio receiver. In similar manner H3 will be cancelled by H4, and H5 will be cancelled by H6. It is pointed out that the magnetic fields were simply illustrated in a single plane whereas in actuality such fields are circumferential to the structure consisting of wires 21-22, with field components that cancel each other everywhere along the length of element 20.

Only two turns or wire transposition segments were illustrated in FIG. 6 for ease of illustration and to assist in clarity of explantion. In actual practice, four type component 20 elements used as cables were constructed and tested for their ability to deliver increased current to the igniters, as measured by suitable instrumentation and also visibly observing the arc intensities across the igniter bases using a suitable test fixture therefor. Cables having lengths of 1.5, 2.0, 2.5 and 3.0 feet were constructed. There was little difference in ignition current magnitudes between the system utilizing any of the four cable lengths indicating that the total capacitive magnitudes may be broad over the range of frequencies encountered in an ignition transient current wave. However, the ignition current increased several fold over the current experienced with the usage of hard copper wire center conductor cables.

For use as an ignition current distribution cable, the configuration of distributed capacity component 20 is superior to other configuations in view of cancellation of both electric and magnetic field components, preventing noise induction into radio receivers and at the same time transmitting ignition current to igniters 65 without substantial attenuation.

It has been experimentally determined that the distributed capacity of component 20 will generally run in the order of 13 picofarads per linear foot.

Figure 8:
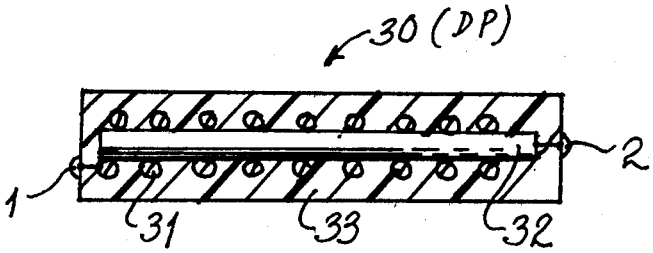
FIG. 8 is a cross-section view partially in elevation of a second version of the distributed capacity parameter component illustrated in FIG. 2.
Figure 9:
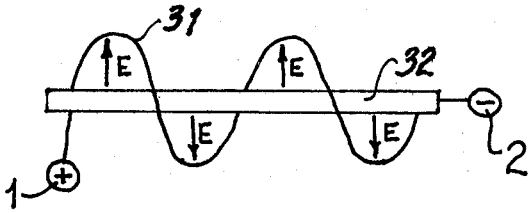
FIG. 9 is a graphical representation of the ignition current flow and electric field relationships involving the structure of FIG. 8.

Referring to FIGS. 8 and 9, distributed inductive-capacitive element 30 is another variation of distributed parameter component DP illustrated in FIGS. 1 and 2. Element 30 incorporates a substantially coaxial structure having a central core at 32 which is electrically insulated from winding 31. Winding 31 is terminated at 1 and core 32 is terminated at 2. Terminations 1 and 2 are the same terminations as illustrated in FIGS. 1 and 2. Core 32 may be metallic or a semiconductor material with an electrically insulating material surrounding the conductor or semiconductor. The end of winding 31 opposite to termination 1 is unterminated. The end of core member 32 opposite to termination 2 is also unterminated. Winding 31 and insulated core 32 are both embedded in a synthetic resin polymer or other electrical insulating material such as at 33.

It may be seen from the equivalent electric field illustration model of FIG. 9, that winding 31 has distributed inductance, a specific value of inductance for each turn of such winding. It may also be appreciated that the distributed capacities of component 30 are inherent by virtue of its construction and proximities of winding 31 to core 32. The distributed capacities will appear between each turn of winding 31 and central core 32.

The distributed capacities formed between each turn of winding 31 and core 32 effect conductive transfer of ignition current via these distributed capacities in similar manner as discussed in conjunction with structure 20. However, this structure possesses the ability to effect cancellation of the electric field components only, as seen in FIG. 9, during displacement current transfer through the distributed capacities.

This structure is usable as a shunt for primary winding 92 and as a cable for ignition current distribution.

Figure 10:
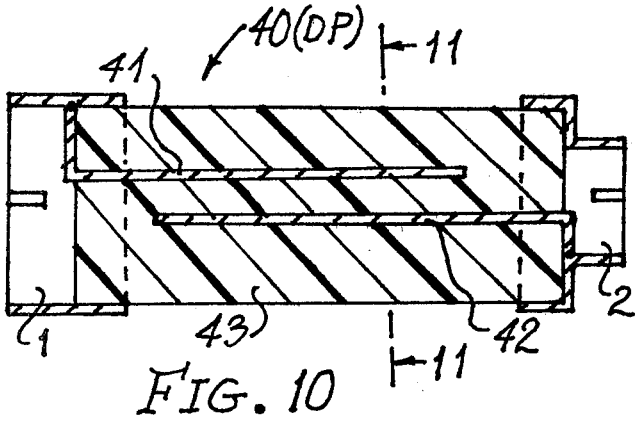
FIG. 10 is a cross-section view of a third version of the distributed parameter component illustrated in FIG. 2.
Figure 11:
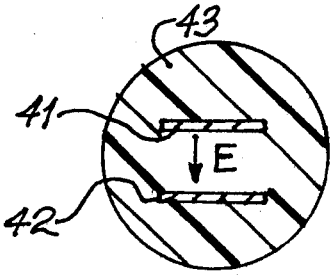
FIG. 11 is a cross-section view taken at plane 11—11 of FIG. 10 and illustrating the electric field presence within such component.

Referring to FIGS. 10 and 11, distributed capacity component 40 is another variation of distributed parameter component DP illustrated in FIGS. 1 and 2.

Component 40 has a pair of prallel rectangular elongated conductors 41 and 42 spaced from each other by means of electrical insulation 43. Insulation 43 also surrounds conductors 41 and 42.

Conductors 41 and 42 are terminated at opposite ends thereof by terminations 1 and 2 respectively, which terminations are the same as illustrated in FIGS. 1 and 2. Component 40 provides displacement current transfer between its elements 41 and 42 of alternating current nature along the direction of electric field vector E shown in FIG. 11. Component 40 is usable as a shunt for secondary winding 92, however in view of inability to provide either electric or magnetic field cancellations, its use as a high voltage distribution cable is of secondary order.

Figure 12:
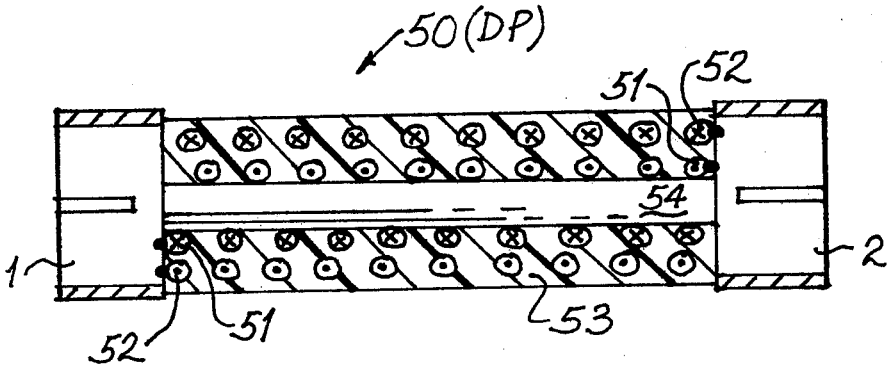
FIG. 12 is a cross-section view partially in elevation of a fourth version of the distributed parameter component illustrated in FIG. 2.
Figure 13:
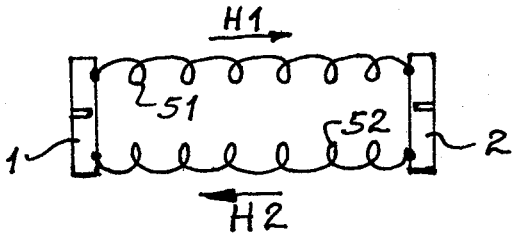
FIG. 13 is a graphical representation of the magnetic field components prevalent in the structure of FIG. 12.

Referring to FIGS. 12 and 13, distributed inductive component 50 has a central electrically insulating core 54 at its axis of elongation. Such component 50 is another variation of the distributed parameter component DP illustrated in FIGS. 1 and 2.

Inductive winding 51, generally utilizing insulated magnetic wire has turns that are wound closely together about core 54 in a clockwise direction. Such winding is illustrated with some spacing between the turns only to enable the structure to be clealy explained.

An electrical insulating material 53 circumscribes and embeds winding 51 and provides insulation over winding 51 for enabling another winding 52 to be wound thereover in a counterclockwise direction and in the same tightly wound turns, as in the case of winding 51.

Winding 51 has one of its ends terminated at termination 1 and the other of its ends terminated at termination 2. Winding 52 has one of its ends terminated at termination 1 and the other of its ends terminated at termination 2. Terminations 1 and 2 are the same terminations as illustrated in FIGS. 1 and 2. The clockwise and counterclockwise windings 51 and 52 are shown in FIG. 12 by means of crosses (x) and dots (•), wherein the crosses (x) indicate current flow into the paper away from the reader and dots (•) indicate current flow out of the paper towards the reader.

The major purpose of FIG. 13 is to more clearly illustrate the parallel connection of windings 51 and 52, and to also illustrate the cancellation of magnetic field components wherein magnetic field H1 is of substantially equal magnitude but opposite in direction to magnetic field H2.

It would appear that structure 50 is unsuitable as a shunt for secondary winding 92 in view of its essentially short circuit effect thereupon. However, this structure is highly suitable for high voltage distribution cable utilization in view of its ability to conduct ignition current without attenuation therethrough while effecting magnetic field cancellation to inhibit radio noise induction.

As may be seen from Tables 1–4 below, a substantial increase in ignition firing voltage and current are obtainable at desired levels by controlling the values of distributed parameter components 20, 30 or 40, whichever is used as an ignition transformer secondary shunt. Such shunt may be included within the casing of the ignition transformer, if desired.

A substantial decrease is possible in the turns ratio of the ignition transformer in view of increased energy levels obtainable by use of such shunt. Hence the ignition transformer size and cost could be substantially reduced.

Additionally, significant electromagnetic field or noise induction into a radio receiver is avoided while passing high ignition currents by utilizing distributed parameter components 20, 30 or 50 as high voltage distribution cables.

A more reliable operating ignition system is obtained by using charge transfer inductor 80 at its indicated location to protect the high power switching transistor Q1.

In view of the extremely high voltages and currents, capable of feeding igniters, as developed by the system, ignition arcs of several inches in length can be generated at conventional engine pressures, if the engine industry was inclined to fabricate igniters with increased diameters and electrode spacing. Such long high energy arcs would smash all the fuel molecules, whether in vaporized or liquid state so as to convert all the injected fuel into the engine to usable mechanical energy, rather than wasting a good portion thereof by resorting to other ignition energy generation and distribution practices, not herein contained.

It should be very carefully noted, that substitution for the distributed parameter components 20, 30 or 40 with a conventional lumped parameter capacitor of the required capacitance and voltage rating is not practical. Any such lumped parameter capacitor construction even if possible would be of enormous size in order to be able to withstand the high voltages imposed across it. In the distributed parameter component the enormous size is avoided since the capacity of the component is distributed along its length, so that only several hundred volts is imposed upon a unit length. Hence substitutions of lumped parameter capacitors either as shunts or as high voltage distribution cables is not practically feasible.

Figure 14:
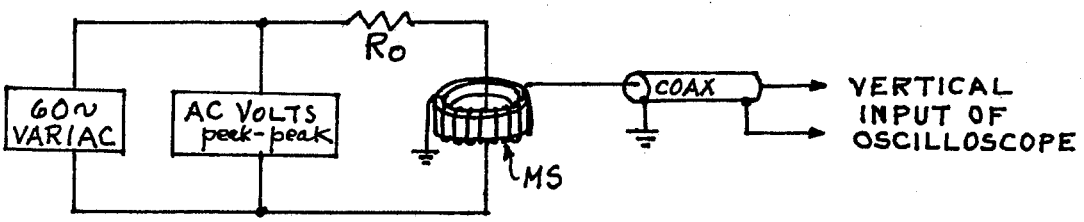
FIG. 14 is a schematic illustration of the method used to calibrate a cathode ray oscilloscope prior to obtaining measured ignition current data.

Referring to FIG. 14, a method utilized to calibrate the vertical deflection sensitivity factor of a cathode ray oscilloscope, employs a 60 cycle VARIAC which is a variable auto-transformer providing a convenient AC output measured by an AC peak-to-peak reading voltmeter. Such voltage output feeds resistor $R_o$, so that current flow through the resistor is measured by means of magnetic sensor MS which picks up a voltage induced therein by one of the connecting wires of the resistor. The induced voltage is imposed upon a small length of coaxial cable connected to the vertical input of the oscilloscope. The VARIAC is adjusted to provide a convenient deflection voltage within the screen of range of the oscilloscope.

Figure 16:
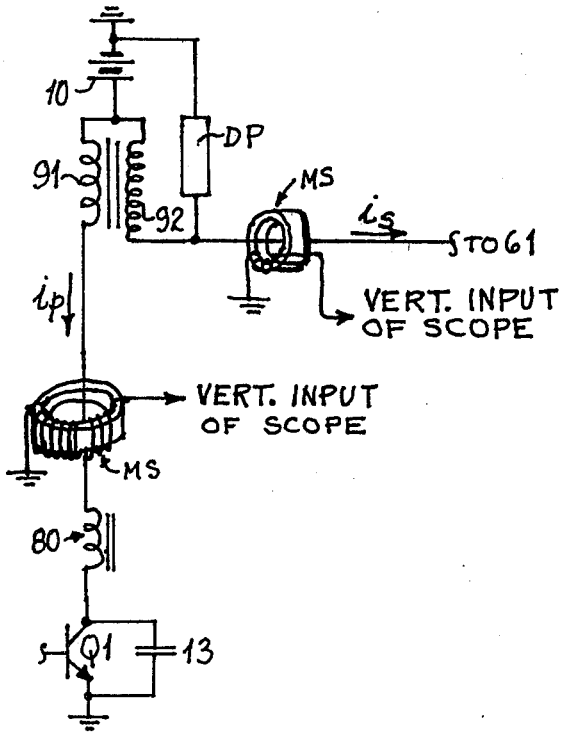
FIG. 16 illustrates the technique used in obtaining ignition current measurements with the oscilloscope as calibrated by the method of FIG. 14.

Using a high wattage resistor $R_o$ of 15 ohms and imposing across it a peak-to-peak voltage of 30 volts, would render a calibration current $$I_{p-p} = \frac{V_{p-p}}{R_o} = \frac{30}{15} = \frac{2 \text{ Amperes } p-p}{\text{Division}}$$

provided the oscilloscope vertical sensitivity control had been set so as to provide a single division peak-to-peak deflection for such 2 ampere current flow. The oscilloscope is now ready for use as a current measuring device, without altering its vertical sensitivity control setting, and capable of reading measured currents in terms of the number of divisions of deflection obtained, in accordance with the scheme for such current measurements as illustrated in FIG. 16.

Hence, if a deflection of 5 divisions occur, then the measured current would be 10 Amperes peak-to-peak.

Magnetic sensor MS has an electrostatic shield thereabout utilizing an aluminum foil wrap where the foil edges were unabutted so as to preclude the equivalent of a shorted turn winding on the MS core.

It should be noted that it is quite valid to utilize measurable low frequencies such as 60 cycles for current or voltage calibration sources since most oscilloscopes are quite linear and have flat responses of their vertical amplification circuits in the range of 1 cycle to a higher order of megacycles.

Figure 15:
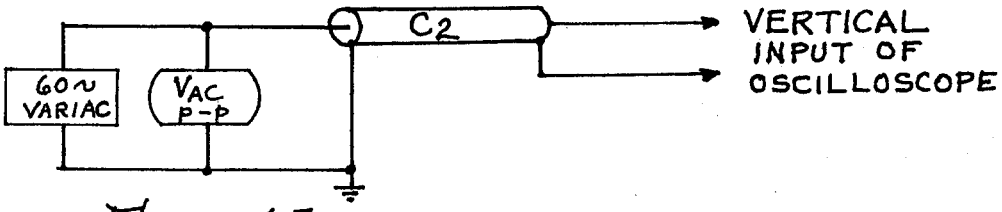
FIG. 15 is a schematic illustration of the method used to calibrate a cathode ray oscilloscope prior to obtaining measured ignition voltage data.

Referring to FIG. 15, a method utilized to calibrate the vertical deflection sensitivity factor of a cathode ray oscilloscope employs the same 60 cycle VARIAC providing convenient AC output measured by the same AC peak-to-peak reading voltmeter. Such voltage output feeds a predetermined length of coaxial cable of known total capacitance and designated as $C_2$, and connected to the vertical input of the oscilloscope.

The VARIAC is set so as to provide a convenient vertical beam deflection within the screen of the oscilloscope. If a 10 volt peak-to-peak level is selected and the oscilloscope vertical sensitivity is set to produce a single division peak-to-peak deflection for such 10 volts, and the vertical sensitivity control is then not moved and measurements are made in accordance with the scheme of FIG. 17, $$V_{p-p} = \frac{10 \text{ Volts } p-p}{\text{Division}}$$

represents the calibration factor.

Figure 17:
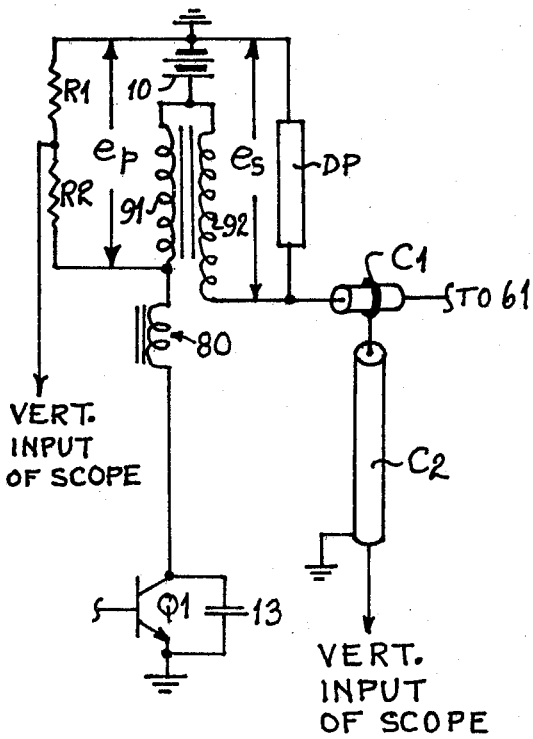
FIG. 17 illustrates the technique used in obtaining ignition voltage measurements with the oscilloscope as calibrated by the method of FIG. 15.

In measuring the high secondary voltages, a capacitive voltage divider method is used as shown by FIG. 17, wherein the voltage is divided by a pair of capacitors, one of them being $C_2$ and the other being a small capacitor value $C_1$ constructed by a single or several turns of wire wrapped around the high voltage distribution cable.

If the ratio of $C_2/C_1 = 1900$, and 3 Divisions of cathode ray beam deflection is obtained from the measurement, the secondary voltage, $$e_s = \frac{10 \text{ Volts } p-p}{\text{Division}} \times 3 \text{ Divisions} \times 1900 = 57 \text{ Kilovolts.}$$

Referring to FIG. 16, both the primary current flow $i_p$ through winding 91, and the ignition secondary current $i_s$ may be measured using the calibration procedure of FIG. 14. It should be noted that the secondary current $i_s$ is herein necessarily defined as the sum of the current flow through winding 92 and distributed parameter DP. FIG. 16 shows parts of FIG. 1 structure to illustrate where the magnetic sensors MS are to be instrumented. Further discussion is not necessary inasmuch as the results of these measurements are tabulated in Tables 1 and 2, and the average values for each distributed capacity component tested is determined in these tables.

Referring to FIG. 17, a portion of FIG. 1 structure is illustrated to show the method of instrumentation for voltage measurement. The primary voltage $e_p$ is measured with a conventional voltage divider network using the voltage substitution method of FIG. 15, so that the measured voltage $e_p$ would be the oscilloscope voltage deflection per division factor multiplied by the ratio of $(R_2+R_1)/R_1$. Therefore, if $R_2$ is 9900 ohms and $R_1$ is 100 ohms, then the ratio is 100. With a calibration factor of 10 volts p-p per division, a 2 division deflection and a multiplication ratio of 100, the primary voltage $e_p$ would be 2000 volts peak-to-peak. The secondary voltage $e_s$ for the same calibration factor and for a multiplication ratio of $C_2/C_1 = 1900$, and a 3 division cathode ray beam deflection would result in a measured value of 57 Kilovolts. The primary and secondary voltages are tabulated in Tables 3 and 4, and the average values for each distributed capacity compnent tested is determined in these tables.

It should be noted that in making the measurements as recorded in Tables 1–4, distributed parameter specie of the types 20 and 30 were utilized as shunts DP in parallel with ignition transformer secondary 92.

Figure 18:
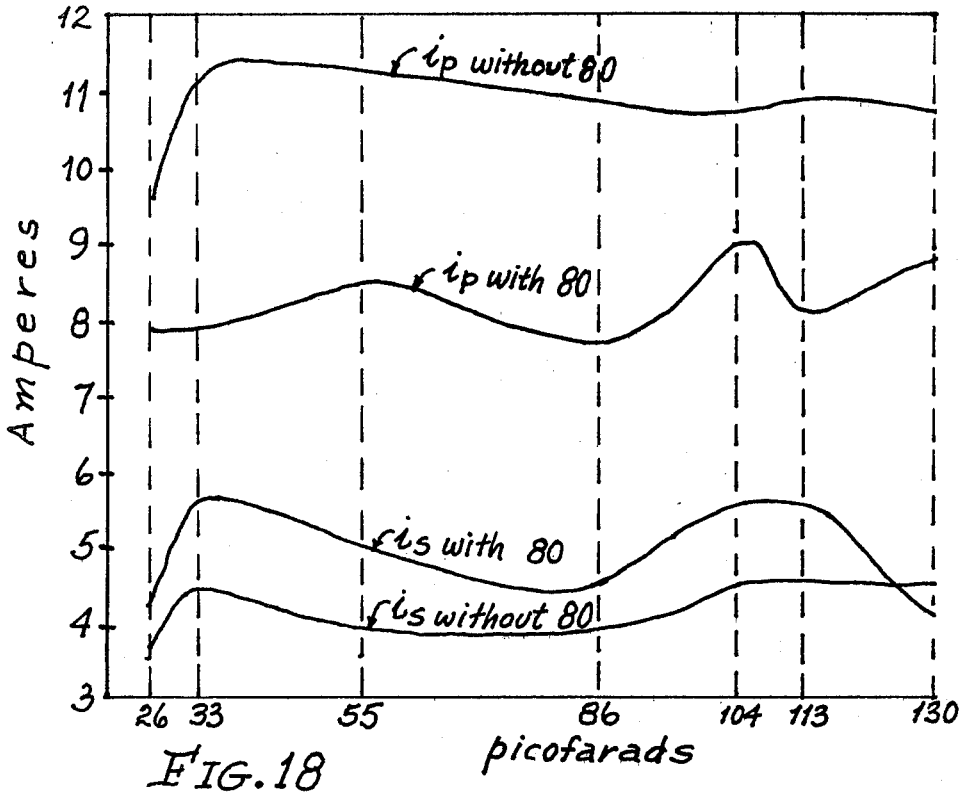
FIG. 18 is a graph of ignition current data as a function of distributed capacity shunt values of shunts in parallel with the ignition transformer secondary winding.
Figure 19:
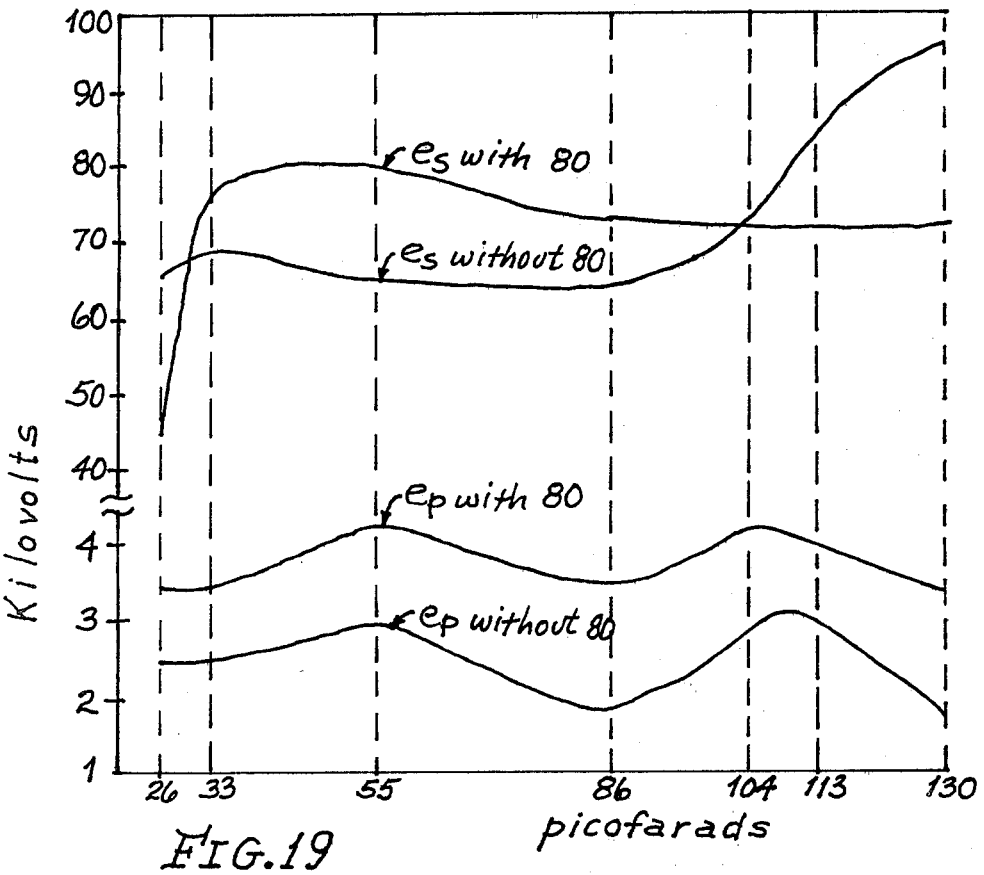
FIG. 19 is a graph of ignition voltage data as a function of distributed capacity shunt values of shunts in parallel with the ignition transformer secondary winding.

Referring to FIGS. 18 and 19, and to Tables 1 through 4, ignition primary current $i_p$ data, ignition secondary current $i_s$ data, ignition primary voltage $e_p$ data and ignition secondary voltage $e_s$ data is graphically illustrated as a funtion of distributed capacity of shunt DP across secondary winding 92. Two sets of data are illustrated wherein one set utilizes transfer charge inductor 80 in the test circuits of FIGS. 16 and 17, and another set of data omits the use of inductor 80 in such test circuits. In both instances, capacitor 13 was utilized in such test circuits.

Comparison of the curves of currents and voltages with and without inductor 80 appears to indicate definite differences in performance. Without use of inductor 80 a larger primary current $i_p$ is indicated than with its use. However, the secondary ignition current $i_s$ is larger when inductor 80 is present in the primary circuit as compared to its omission.

In the case of ignition voltages, the primary voltage $e_p$ is greater with use of inductor 80 than with its deletion. But the secondary voltage $e_s$ is generally lower but more constant over the range of distributed capacity values utilized than what is obtained by deleting inductor 80.

The larger secondary current $i_s$ and the more constant secondary voltage $e_s$ with the usage of inductor 80 would therefore be advantageous in desired performance characteristics.

It should be noted that in establishing the data of Tables 1–4, the measured values relative to each other are of greater significance in comparing performances of varied circuit conditions rather than the absolute values of such measurements taken for any single circuit condition.

TABLE 1

| | Peak-to-Peak Primary Current $i_p$ in Amperes | | | | |
|---|---|---|---|---|---|
| DP in pF | with inductor 80, with capacitor 13 | without inductor 80, with capacitor 13 | with inductor 80, without capacitor 13 | without inductor 80, without capacitor 13 | Average Amperes |
| 26 | 7.9 | 9.6 | 6.5 | 8.1 | 8.0 |
| 33 | 7.9 | 11.3 | 6.5 | 8.2 | 8.5 |
| 55 | 8.5 | 11.3 | 6.8 | 8.3 | 8.7 |
| 86 | 7.6 | 8.5 | 6.8 | 8.8 | 7.9 |
| 104 | 9.0 | 10.6 | 6.8 | 8.8 | 8.8 |
| 113 | 8.0 | 10.8 | 6.8 | 8.7 | 8.6 |
| 130 | 8.7 | 10.7 | 7.0 | 9.0 | 8.9 |

TABLE 2

| DP in pF | Peak-to-Peak Secondary Current $i_s$ in Amperes: with inductor 80, with capacitor 13 | without inductor 80, with capacitor 13 | with inductor 80, without capacitor 13 | without inductor 80, without capacitor 13 | Average Amperes |
|---|---|---|---|---|---|
| 26 | 4.2 | 3.7 | 4.7 | 3.4 | 4.0 |
| 33 | 5.6 | 4.5 | 5.6 | 5.6 | 5.3 |
| 55 | 5.0 | 3.9 | 5.0 | 5.0 | 4.7 |
| 86 | 4.5 | 3.9 | 4.5 | 3.9 | 4.2 |
| 104 | 5.6 | 4.5 | 5.6 | 4.5 | 5.1 |
| 113 | 5.6 | 4.5 | 5.6 | 4.5 | 5.1 |
| 130 | 4.0 | 4.5 | 5.6 | 4.5 | 4.7 |

TABLE 3

| DP in pF | Peak-to-Peak Primary Voltage $e_p$ in Kilovolts: with inductor 80, with capacitor 13 | without inductor 80, with capacitor 13 | with inductor 80, without capacitor 13 | without inductor 80, without capacitor 13 | Average Kilovolts |
|---|---|---|---|---|---|
| 26 | 3.4 | 2.5 | 3.4 | 3.4 | 3.2 |
| 33 | 3.4 | 2.5 | 3.4 | 2.5 | 3.0 |
| 55 | 4.2 | 3.0 | 4.2 | 3.0 | 3.6 |
| 86 | 3.4 | 1.7 | 3.0 | 1.4 | 2.4 |
| 104 | 4.2 | 3.0 | 4.2 | 2.5 | 3.5 |
| 113 | 3.8 | 3.0 | 5.0 | 3.8 | 3.7 |
| 130 | 3.4 | 1.7 | 3.8 | 2.0 | 2.7 |

TABLE 4

| DP in pF | Peak-to-Peak Secondary Voltage $e_s$ in Kilovolts: with inductor 80, with capacitor 13 | without inductor 80, with capacitor 13 | with inductor 80, without capacitor 13 | without inductor 80, without capacitor 13 | Average Kilovolts |
|---|---|---|---|---|---|
| 26 | 44 | 65 | 44 | 76 | 57 |
| 33 | 76 | 68 | 76 | 96 | 79 |
| 55 | 80 | 64 | 68 | 60 | 68 |
| 86 | 72 | 64 | 56 | 68 | 65 |
| 104 | 72 | 72 | 72 | 72 | 72 |
| 113 | 72 | 84 | 76 | 80 | 78 |
| 130 | 72 | 96 | 112 | 80 | 90 |

I claim:

1. A transmission cable, in an ignition system having an ignition transformer and an electrical igniter, for enabling ignition current to be fed to said igniter, said cable comprising:

an insulating core elongated along the length of the cable and substantially constituting the axis of elongation of the cable;

first inductive means, wound in a first direction substantially over the entire length of the core; and second inductive means, electrically insulated from and wound over substantially the entire length of the first means in a second direction opposite to the first direction, said first and second inductive means being connected in parallel for passing ignition current therethrough between the transformer and igniter, said first and second inductive means being coaxial windings each of which comprise turns of insulated wire, said turns being wound in a plane substantially perpendicular to the axis of elongation and in close proximity to each other.

2. The invention as stated in claim 1, wherein said first and second inductive means provide a plurality of pairs of opposing fields of substantially equal magnitudes.

3. A transmission cable within an ignition system, said system having an ignition transformer and an electrical igniter, for enabling ignition current to be fed to said igniter, said cable comprising:

a distributed parameter component having a first electrically conductive elongated member and a second electrically conductive elongated member insulated from the first member, said component having a first end and a second end opposite from the first end, the first member being terminated at said first end and the second member being terminated at said second end, said first member being unterminated at said second end and said second member being unterminated at said first end, said terminated ends electrically coupling the transformer to the igniter, said members being straight and substantially parallel to each other.

4. The cable as stated in claim 3 comprising a distributed capacity element.

* * * * *